US006019861A

United States Patent [19]

Canterberry et al.

[11] Patent Number: 6,019,861

[45] Date of Patent: Feb. 1, 2000

[54] GAS GENERATING COMPOSITIONS CONTAINING PHASE STABILIZED AMMONIUM NITRATE

[75] Inventors: J B Canterberry, Apollo Beach; Samuel Steven Schlueter, Plant City; John Herman Adams; Robert Keith Walsh, both of Lakeland, all of Fla.

[73] Assignee: Breed Automotive Technology, Inc., Lakeland, Fla.

[21] Appl. No.: 08/946,467

[22] Filed: Oct. 7, 1997

[51] Int. Cl.[7] ..... C06B 45/10

[52] U.S. Cl. ..... 149/19.1; 149/36; 149/37; 149/44; 149/46

[58] Field of Search ..... 149/19.1, 46, 44, 149/36, 37

[56] References Cited

U.S. PATENT DOCUMENTS

| | | | |
|---|---|---|---|
| 2,590,054 | 3/1952 | Taylor et al. | 149/2 |
| 2,657,977 | 11/1953 | Stengel et al. | 423/266 |
| 2,943,928 | 7/1960 | Guth . | |
| 3,212,944 | 10/1965 | Lyon et al. | 149/21 |
| 3,428,418 | 2/1969 | McFarlin et al. | 423/275 |
| 3,905,515 | 9/1975 | Allemann | 222/3 |
| 3,912,562 | 10/1975 | Garner | 149/41 |
| 3,996,078 | 12/1976 | Klunsch et al. | 149/2 |
| 4,001,377 | 1/1977 | Hahn et al. | 423/267 |
| 4,111,728 | 9/1978 | Ramnarace | 149/19.5 |
| 4,124,368 | 11/1978 | Boyars | 71/59 |
| 4,158,583 | 6/1979 | Anderson | 149/19.4 |
| 4,552,736 | 11/1985 | Mishra | 423/266 |
| 4,919,897 | 4/1990 | Bender et al. | 422/165 |
| 4,925,600 | 5/1990 | Hommel et al. | 264/3.4 |
| 5,035,757 | 7/1991 | Poole | 149/46 |
| 5,071,630 | 12/1991 | Oberth | 423/266 |
| 5,098,683 | 3/1992 | Mehrotra et al. | 423/266 |
| 5,139,588 | 8/1992 | Poole | 149/61 |
| 5,292,387 | 3/1994 | Highsmith et al. | 149/19.1 |
| 5,386,775 | 2/1995 | Poole et al. | 102/289 |
| 5,439,537 | 8/1995 | Hinshaw et al. | 149/37 |
| 5,500,061 | 3/1996 | Warren et al. | 149/19.4 |
| 5,507,891 | 4/1996 | Zeigler | 149/47 |
| 5,516,377 | 5/1996 | Highsmith et al. | 149/18 |
| 5,531,941 | 7/1996 | Poole | 264/3.4 |
| 5,551,725 | 9/1996 | Ludwig | 280/737 |
| 5,583,315 | 12/1996 | Fleming | 149/19.4 |
| 5,589,661 | 12/1996 | Menke et al. | 149/19.4 |
| 5,596,168 | 1/1997 | Menke et al. | 149/19.4 |
| 5,726,382 | 3/1998 | Scheffee et al. | 149/19.91 |
| 5,739,460 | 4/1998 | Knowlton et al. | 149/45 |
| 5,783,773 | 7/1998 | Poole | 149/36 |
| 5,866,842 | 2/1999 | Wilson et al. | 149/19.6 |

FOREIGN PATENT DOCUMENTS

| | | | |
|---|---|---|---|
| 0689527 | 3/1997 | European Pat. Off. | 45/10 |
| WO/95/09825 | 4/1995 | Germany . | |

*Primary Examiner*—Edward A. Miller
*Attorney, Agent, or Firm*—L. R. Drayer; D. O. Nickey

[57] ABSTRACT

Gas generating compositions contain a non-azide fuel, phase stabilized ammonium nitrate (PSAN) and silicon. These gas generant compositions yield inflation gases having a reduced content of undesirable gases such as $NO_x$ and CO. The gas generanting compositions preferably contain 5-aminotetrazole at a concentration of 15–30 wt. % as the fuel, an oxidizer system at a concentration of 35–80 wt. % which comprises phase stabilized ammonium nitrate, at least 0.5 wt. % silicon, about 1 wt. % iron oxide and at least one material selected from binders and processing aids. The gas generating compositions are useful for inflating vehicle occupant restraint devices and for pyrotechnically operated fire suppression devices. The high level of gases produced by the compositions of the invention allow for smaller inflators which reduce the costs of production and the saving of weight.

23 Claims, No Drawings

GAS GENERATING COMPOSITIONS CONTAINING PHASE STABILIZED AMMONIUM NITRATE

The present invention generally relates to novel gas generating compositions used for inflating occupant safety restraints in motor vehicles, aircraft and the like. More specifically, this invention relates to non-azide based gas generants that contain up to 80 wt. % phase stabilized ammonium nitrate (PSAN) and up to 7.0 wt. % silicon, which produce combustion products having acceptable levels of undesirable substances. In a most preferred embodiment, the gas generant additionally contains up to 7.0 wt. % iron oxide.

BACKGROUND OF THE INVENTION

Inflatable occupant restraint devices for motor vehicles have been under development worldwide for many years. Gas generating compositions for inflating the occupant restraint devices have also been under development for many years and numerous patents have been granted thereon. Because the inflating gases produced by the gas generants must meet strict toxicity requirements, most, if not all gas generants now in use, are based on alkali or alkaline earth metal azides. Sodium azide is presently the preferred fuel for gas generant compositions as it reacts with oxidizing agents to form a relatively non-toxic gas consisting primarily of nitrogen.

A major problem associated with azide based gas generants is the extreme toxicity of the azide itself. The toxicity of the azide based generants makes their use inherently difficult and relatively expensive. In addition, the potential hazard and disposal problems of unfired inflation devices containing azide based generants must be considered.

In contrast, the non-azide based gas generants (i.e., 5-aminotetrazole) provide significant advantages over the azide based gas generants with respect to hazards during manufacture and disposal. Unfortunately, a number of non-azide based gas generants heretofore known produce unacceptably high levels of undesirable substances upon combustion (i.e., toxic gases and particulates). The most difficult undesirable gases to control are the various oxides of nitrogen ($NO_x$) and carbon monoxide (CO). Typical non-azide gas generants require the use of oxidizers such as strontium nitrate, sodium nitrate, potassium nitrate and the like to achieve a burn rate that produces a significant amount of gas in the required time period.

The reduction of the level of undesirable gases upon combustion of non-azide gas generants and a reduction of the formation of solid combustion particles (slag) requires a special combination of materials. For instance, manipulation of the oxidizer/fuel ratio reduces either the $NO_x$ or CO. More specifically, increasing the ratio of oxidizer to fuel minimizes the CO content upon combustion because the extra oxygen oxidizes the CO to carbon dioxide. Unfortunately, this approach results in increased amounts of $NO_x$. The relatively high levels of $NO_x$ and CO produced upon combustion of non-azide gas generants and the difficulty presented in forming easily filterable solid combustion products is due, in part, to the relatively high combustion temperatures exhibited by the conventional non-azide gas generants. Utilizing lower energy fuels to reduce the combustion temperature is ineffective because the lower energy fuels do not provide a sufficiently high rate of gas generation, or burn rate, for use in vehicle restraint systems. Adequate burn rate of the gas generant is required to ensure that the airbag system will operate readily and properly.

The aforementioned problems are solved by the present invention, which discloses gas generants that contain from 35–80 wt. % PSAN, from 15–30 wt. % non-azide fuel and 0.5–7.0 wt. % metallic silicon. The generant of the invention may also contain iron oxide at up to 7.0 wt. % and an organic binder at up to 5.0 wt. %. The gas generants of this invention produce low levels of easily filterable combustion products and rapidly produce inflating gases in sufficient quantities with a minimum production of undesired gases. More preferably, this invention relates to non-azide based gas generants that contain up to about 75 wt. % PSAN, up to about 3 wt. % metallic silicon and up to about 3 wt. % iron oxide.

U.S. Pat. No. 3,912,562 discloses a gas generating composition which comprises a fuel such as a carbonaceous material, aluminum or magnesium; an inorganic oxidizer such as metal chlorates, metal perchlorates and ammonium nitrate; and a coolant such as magnesium hydroxide and/or magnesium carbonate.

U.S. Pat. No. 5,583,315 discloses a smoke free propellant containing 40–85 wt. % AN, 4–40 wt. % of a binder, 0–40 wt. % of an energetic plasticizer and 0.1–8.0 wt. % of a reinforcing agent.

U.S. Pat. No. 5,035,757 discloses a gas generating mixture useful for inflating an automobile crash bag, the pyrotechnique mixture comprising: (1) a fuel selected from the azole compounds; (2) an oxygen containing oxidizer; (3) a high temperature slag forming material selected from a group consisting of alkaline earth metal oxides, hydroxides, carbonates and oxalates; and (4) a low temperature slag forming material selected from the group consisting of silicon dioxide, boric oxide, alkaline metal silicates and naturally occurring clays and talcs.

U.S. Pat. No. 5,139,588 discloses a gas generating composition comprising: (1) a non-azide fuel; (2) an oxygen containing oxidizer; (3) an alkaline earth metal salt of an inorganic or organic acid such as 5-aminotetrazole; and (4) a low temperature slag forming material selected from clays, talcs and silica.

U.S. Pat. No. 5,531,941 discloses gas generant compositions comprising triaminoguanadine and phase stabilized ammonium nitrate. This patent also discloses a process for the preparation of such compositions.

U.S. 5,386,775 discloses an azide-free gas generant composition that contains a low energy nitrogen containing fuel combined with a burn rate accelerator comprising alkali metal salts of organic acids. Examples of a low energy nitrogen containing fuel are ammonium oxalate, glycine nitrate and azodicarbonamide. This patent also provides examples of organic acids as tetrazoles, triazoles, 5-aminotetrazole, 5-nitroaminotetrazole and bitetrazoles. This patent does not suggest nor disclose the use of a PSAN based oxidizer system in combination with 0.5 to 7 wt. % silicon.

U.S. Pat. No. 5,516,377 discloses a gas generating composition comprising 5-nitraminotetrazole and an oxidizer selected from metal oxides, inorganic nitrates, metal peroxides, metal hydroxides and mixtures thereof.

U.S. Pat. No. 5,507,891 discloses propellant compositions which function with hybrid inflator systems. The propellant composition of this reference comprises a fuel such as cyclotrimethylenetrinitramine at 40–80 wt. %; an oxidizer such as ammonium nitrate at 0–35 wt. % and an inert or energetic binder at 0–15 wt. %

U.S. Pat. No. 5,500,061 discloses the addition of silicon (Si) powder at about 0.4–6 wt % to unstabilized ammonium nitrate propellant formulations to increase the performance specific impulse. The formulations of this reference are designed for rocket motors and utilize energetic binders such as glycidyl azide polymers. Further, the compositions disclosed in this patent have specific impulse values of 234–250 seconds at 6895 kPa (1000 psi) motor operating pressure. In contrast, the gas generants of the present invention have specific impulses less than 225 seconds at 6895 kPa (1000 psi). In addition, Warren uses a castable urethane binder system which presents toxicity problems and increased costs in vehicle restraint systems.

U.S. Pat. No. 4,111,728 discloses a castable gas generator composition comprising 25–40 wt. % of a binder of polyether or polyester and 45–60 wt. % ammonium nitrate coated with a compound selected from the group consisting of magnesium oxide and magnesium nitrate; and an effective amount of a burn rate modifier.

U.S. Pat. No. 5,596,168 and U.S. Pat. No. 5,589,661 disclose a solid propellant for rocket propulsion systems or gas generants that comprises 35–80 wt. % of a phase stabilized ammonium nitrate; 15–50 wt. % of a high energy binder system containing an energy rich plasticizer and 0.2–5 wt. % of burn rate modifier selected from vanadium oxide and molybdenum oxide.

U.S. Pat. No. 4,158,583 discloses a high performance rocket propellant with greatly reduced hydrogen chloride emissions. The propellant comprises a hydrocarbon binder at 10–15 wt. %, ammonium nitrate (AN) at 40–70 wt. %; 5–25 wt. % of a powdered metal fuel such as aluminum and 5–25 wt. % of ammonium perchlorate.

AN contains no halogens, burns without smoke production and is less toxic than other conventionally employed oxidizing materials. AN is, other than ammonium perchlorate, one of the few readily available, inexpensive, inorganic oxidizers useful in energetic applications. AN is also the only inorganic oxidizer which will burn completely to a non-toxic gas, leaving no solid residue.

However, the attractiveness of current commercially available ammonium nitrate in energetic compositions is tempered by several severely limiting drawbacks. Such drawbacks include an energetic performance significantly lower than comparable ammonium perchlorate-based compositions, low burning rates at relatively high pressures compared to other oxidizer-containing compositions, and greater hygroscopicity (moisture sensitivity) than ammonium perchlorate.

Also, ammonium nitrate is thermally unstable. AN passes through five distinct crystal phase changes from about −17° C. to 169° C. The most disadvantageous change or transition is the Phase IV⇆Phase III transition, occurring at about 32.3° C. This Phase IV⇆Phase III transition is characterized by a significant irreversible increase in crystal volume. Thus, repeated cycling of ammonium nitrate-based pyrotechnique compositions through the Phase IV to Phase III transition temperature is known to cause growth of the grain and destruction of grain integrity. The result is an increased porosity and loss in mechanical strength which is highly undesirable in energetic composition.

Over the years, numerous efforts to stabilize ammonium nitrate to prevent or sufficiently suppress the Phase IV⇆Phase III transition have been made. In the agrochemical field, a wide variety of ingredients have been tried at one time or another to prevent caking. In the energetic composition field, efforts to stabilize AN have included combining ammonium nitrate with materials such as potassium nitrate, zinc oxide, magnesium oxide, potassium fluoride and nickel oxide. Certain lithium, calcium, barium, aluminum salts and other metal salts of the nitrate anion have also been used. Further, compounds such as urea, ethylene diamine nitrate, diethylene triaminotrinitrate, guanidinium nitrate, silicates, and for instance, melamine have also been investigated as ammonium nitrate stabilizers.

The following patents disclose various techniques to produce a phase stabilized ammonium nitrate: U.S. Pat. No. 5,292,387; U.S. Pat. No. 4,001,377; U.S. Pat. No. 4,124,368; U.S. Pat. No. 4,552,736; U.S. Pat. No. 4,925,600; U.S. Pat. No. 5,098,683; U.S. Pat. No. 2,590,054; U.S. Pat. No. 2,657,977; U.S. Pat. No. 2,943,928; U.S. Pat. No. 3,212,944; and U.S. Pat. No. 3,428,418.

EP 0689527B1 relates to ammonium nitrate stabilized with certain metal dinitramide salts. This reference teaches that a dinitramide salt such as potassium dinitramide is present in the mixture at levels of from 5–25 wt. %. The propellant compositions using the stabilized AN include metal fuels such as aluminum, boron, magnesium and the like; a suitable binder; and a ballistic catalyst such as aluminum oxide or zirconium carbide.

None of the above discussed references disclose gas generant compositions which will function satisfactorily in airbag inflator systems. The required need of high burn rates, low toxicity of combustion gases, reduced particulate production and reduced tendency to self-extinguish is accomplished through the novel and unobvious formulation of this invention.

SUMMARY OF THE INVENTION

A primary advantage of the gas generant compositions of this invention resides in the reduced levels of undesirable gases which are produced and the reduced cost of gas generant. The phase stabilized ammonium nitrate (PSAN) oxidizer is substantially less expensive than the oxidizers typically used with non-azide fuels. The gas generant of this invention utilizes non-azide fuels and preferably uses azoles or tetrazole salts as the fuel. An additional unique feature of this invention is the novel and unobvious use of PSAN, silicon and iron oxide which produces a high volume of gas in a short period of time which is required for modern inflators.

Another potential use of this invention is in pyrotechnically operated fire suppression devices. These devices generally require the generation of large amounts of inert gases for blanketing a region of burning material. A highly controlled effluent is just as important in these applications, as over-oxidized or under-oxidized gases can contribute to a fire as oxidizer or fuel, and many of the toxic species avoided in automotive applications are to be avoided in fire suppression as well. The relatively low combustion temperature of these generants as compared to other technologies is also desirable for fire suppression.

Thus, there is disclosed a gas generant comprising: (a) between about 15 and about 30 wt. % of a non-azide fuel; (b) between about 35 and about 80 wt. % of PSAN; and (c) between about 0.5 and about 7.0 wt. % of silicon. Preferably, the gas generant additionally comprises up to 7.0 wt. % iron oxide and up to 5.0 wt. % of an organic binder. More preferably, the gas generant contains from 22–26 wt. % of the non-azide fuel, at least 60 wt. % of the oxidizer system, about 2.0 wt. % of silicon, about 1.0 wt. % iron oxide and about 1 wt. % binder.

Representative of the non-azide fuels useful in the present invention include guanidine nitrate, oxamide, ammonium oxalate, aminoguanidine bicarbonate, hydrazodicarbonamide, azodicarbonamide, the tetrazoles, bitetrazoles, triazoles and mixtures thereof. Preferred non-azide fuels used in the gas generants of the invention include 5-aminotetrazole, ammonium oxalate, azodicarbonamide and mixtures thereof.

There is further disclosed a gas generant composition comprising 15 to 30 wt. % of a fuel selected from tetrazoles, triazoles azodicarbonamide, ammonium oxalate and mixtures thereof; 35–80 wt. % of an oxidizer system comprising alkali and alkaline earth metal nitrates and perchlorates and AN; and 0.5 to 7 wt. % silicon. The gas generants of this invention may be incorporated into vehicle occupant restraint devices or pyrotechnically operated fire suppression devices.

The alkali and alkaline earth metal nitrates and perchlorates useful in the oxidizer system of this invention include potassium nitrate, potassium perchlorate, strontium nitrate, sodium nitrate, ammonium perchlorate, magnesium nitrate ($Mg(NO_3)_2$), barium nitrate ($Ba(NO_3)_2$) and calcium nitrate ($Ca(NO_3)_2$). The mixture of oxidizers is preferably co-precipitated with the AN from an aqueous solution in order to phase stabilize the AN. The oxidizer system may also be prepared by melting the components and mixing them to provide a PSAN.

The source of AN is not important as various grades of AN, such as agricultural or propellant grades will be useful in this invention. Any grade of AN can be used as the processing of the AN to form PSAN makes all sources equivalent.

The present invention also relates to a novel method of producing a PSAN which comprises the steps of: (a) dissolving potassium nitrate, strontium nitrate and AN in water wherein the weight ratio of potassium nitrate to strontium nitrate to ammonium nitrate can range from 1:1:2 to 3:1:12 to form a solution; (b) heating said solution to a temperature up to 80° C. with agitation; and (c) drying the solution to a water content of less than 1 wt. %.

There is further disclosed a gas generant composition comprising: (a) a non-azide fuel; (b) PSAN; and (c) one or more processing aid(s), the improvement characterized in that said gas generant additionally comprises 0.5–7 wt. % silicon and 0.5–5.0 wt. % iron oxide.

The invention also relates to a non-azide gas generant composition comprising: (a) PSAN; (b) at least one nitrogen-containing fuel selected from the group consisting of triazoles, tetrazoles and salts thereof and mixtures thereof; (c) 0.5–7.0 wt. % silicon; and (d) iron oxide. The ratio of PSAN to fuel can be adjusted to result in the production of a combustion gas that contains less than 3.0% by volume oxygen. The gas generant composition of this invention are useful in pyrotechnically operated fire suppression devices. The make-up of the gases generated by the inventive composition can be carefully controlled so that they do not provide oxygen or fuel to the fire to be extinguished.

The AN based gas generant compositions of this invention are easily prepared, low in cost, avoid the generation of substantial levels of undesirable gases, and allow for the efficient filtering of solid materials generated during the combustion of the gas generant.

DETAILED DESCRIPTION OF THE INVENTION

The principal advantages of the gas generant compositions of this invention are low production costs, very high gas yields with low toxicity and low yield of solid combustion products. Gas yields of greater than 80 wt. % are typically obtained. Actual yields are about 85–95% gas and these high yields of gas permit smaller inflators (saving in cost of production and weight) and the low level of solids allows for smaller and less expensive filters or the elimination of the filter entirely. As used herein and in the claims, the term "wt. %" means the weight of the recited component compared to the weight of the entire composition expressed as a percentage.

The gas generant formulations of this invention may be formulated with any known non-azide fuel. Fuels useful in this invention include the azoles, tetrazoles, (i.e., 5-aminotetrazole, 5-ATZ), bitetrazoles, metal salts of tetrazoles, 1,2,4-triazole-5-one, nitrates, (i.e., guanidine nitrate and aminoguanidine nitrate) azodicarbonamide, ammonium oxalate and the like. Mixtures of non-azide fuels can be used in the compositions of the invention. The fuel will typically comprise between about 15 and about 30 wt. % of the gas generant composition, while the oxidizer system (PSAN and/or AN plus others) will typically comprise between about 35 and about 80 wt. % of the gas generant composition. The composition also contains from 0.5–7 wt. % of silicon and may also contain iron oxide and organic binders.

A critical aspect of this invention is the inclusion of 0.5–7.0 wt. % of silicon in the gas generant. Silicon is a chemical element that makes up about 27.7% of the Earth's crust. Silicon does not occur uncombined in nature but is found in practically all rocks, sands, clays and soils combined with oxygen as silica ($SiO_2$) or with oxygen and other elements such as aluminum, calcium, sodium or iron.

Pure silicon is a hard, dark gray solid with a metallic luster and with a crystalline structure the same as that of diamond. Silicon is commercially prepared by reducing the oxide by its reaction with coke in electric furnaces. Elemental silicon has uses in metallurgy as a reducing agent and as an alloying element in steel, brass and bronze. Highly purified silicon is used in photoelectric devices, transistors and other electronic components.

The silicon useful in the present invention is a powder with a particle size of about 2–100 microns and is commercially available from numerous sources.

Processing aids, such as silicon dioxide, may also be used in the present invention. Those skilled in the art understand that depending upon the particular oxidizers and fuels utilized, certain processing aids have beneficial properties over others. Representative of processing aids useful in the present invention are silica TS-530 (made by the Cabot Corporation of Tuscola, Ill., U.S.A.), boron nitride, talc, mica and clays (i.e., bentonite clays). Typically, about 1 wt. % of a processing aid will be found useful in the present invention.

Oxidizers in addition to the PSAN useful in the composition of the present invention include the alkaline earth and alkali metal nitrates such as strontium nitrate and potassium nitrate. The preferred oxidizer system of the present invention is a mixture of strontium nitrate, potassium nitrate and AN that have been co-precipitated. The particle size of the oxidizer system should be from about 5 to 30 microns.

The gas generant according to this invention may also include binders to assist in the formation of pellets and to promote the integrity of the pellets. Typical binders known in the art can be used such as the epoxy, polycarbonate polyvinyls, elastomeric hydrocarbons, polyester or polyurethane polymeric binders. The preferred hydrocarbon binder is the group of polymers known as the polyacrylates.

Because of the large amount of carbon in organic polymers, their use in gas generants for automotive airbags must be lower than the levels found in more conventional propellants (i.e., rocket propellants). In those compositions of the present invention wherein a binder is employed, the amount of binder would be no more than about 5 wt. % and is more likely to be in the range of about 1–3 wt. % when used in this invention.

Iron oxide ($Fe_2O_3$) is preferably included in the gas generants of this invention as a shift catalyst. "Shift catalyst" means a catalyst useful to result in shifting the production of toxic combustion gases to the production of non-toxic gases. The level of iron oxide in the present invention can range from 0–7 wt. %, more preferably from 0.5–5.0 wt. % and most preferably from 0.5–3.0 wt. %. The particle size of the iron oxide is less than 50 microns and most preferably less than 5 microns. Numerous sources of iron oxide are available and most forms will be useful in the gas generants of this invention. Representative of an iron oxide useful in this invention is Bayferrox® from Bayer Corp. of Pittsburgh, Pa. U.S.A.

A preferred embodiment of the gas generant of this invention is when the components are compressed into a pellet form. The burning rate of the pellet should typically be greater than 1.2 cm (0.5 inch) per second at 6.9 MPa (1000 psi) and more preferably greater than 1.9 cm (0.75 inch) per second at 6.9 MPa (1000 psi). Further, the gas generants of this invention will typically have burn rates in excess of 1.27 cm (0.5 inches) per second at 13.8 Mpa (2000 psi).

The invention in another embodiment comprises a process for preparing the PSAN and the azide free gas generant composition comprising the steps of (a) dissolving together weighed amounts of AN, potassium nitrate ($KNO_3$) and strontium nitrate $(SrNO_3)_2$, in ambient to hot (about 80–85° C.) water; (b) drying the mixture to a cake with a moisture content of less than about 0.5 wt. % to obtain a dry oxidizer system; (c) grinding the cake to a powder having a particle size of less than 50 microns, preferably less than 20 microns; (d) weighing the oxidizer system powder, a powdered non-azide fuel, silicon and iron oxide; (e) mixing the oxidizer system powder, the powdered non-azide fuel, silicon and iron oxide and at least one component selected from the group of processing aids; (f) dissolving a binder in an appropriate solvent; (g) weighing the binder in solution; (h) mixing the blend of step (e) with the binder in solution to result in a paste; (I) heating the paste to evaporate solvent to produce a solvent damp crumb; (j) passing the damp crumb through an 8 mesh screen; (k) drying the crumb; (l) passing the dried crumb through a granulator with a 20 mesh screen to form fine granules; and (m) molding the fine granules under pressure to form pellets.

The invention will now be described in greater detail by way of specific examples.

EXAMPLE I

Preparation of PSAN/Oxidizer System

A quantity of the inventive oxidizer system was prepared by heating a mixture of 4 parts by weight agriculture grade AN (0.45 wt. % MnO to prevent caking), 1 part by wt. $KNO_3$ and 1 part by wt. $Sr(NO_3)_2$ in enough water to dissolve all of the solids when heated to about 80° C. The solution was then agitated for a few minutes and the resulting solution was then poured into pans and dried in an oven at 75–90° C. After drying, the solid material (cake) was ground to a fine granular form with a particle size of about 20 microns.

EXAMPLE II

Preparation of Gas Generant

A one kilogram batch of each of six (6) gas generant compositions were formulated according to Table I below. The compositions were prepared by initially mixing the oxidizer system prepared in accordance with Example I with all of the other components, except for the binder.

TABLE I

AMMONIUM NITRATE-BASED FORMULATIONS*
(Values in Weight %)

| SAMPLE # | N | $KNO_3$ | $Sr(NO_3)_2$ | $KClO_4$ | 5-ATZ | $CaCO_3$ | $SiO_2$ | Si | $Fe_2O_3$ | ADCA | AO | BINDER |
|---|---|---|---|---|---|---|---|---|---|---|---|---|
| 1 (99) | 44.00 | 11.00 | 11.00 | | 25.00 | 4.00 | 5.00 | | | | | |
| 2 (102) | 44.00 | 11.00 | 11.00 | | 25.00 | 3.00 | | 3.00 | 3.00 | | | 1.00[3] |
| 3 (125) | 44.00 | 11.00 | 11.00 | | 25.00 | 4.00 | 1.00 | 2.00 | 3.00 | | | 1.00[3] |
| 4 (128) | 58.00 | | | 16.00 | 26.00 | | | | | | | 1.00[3] |
| 5 (129) | 50.00 | 12.50 | 12.50 | | 23.00 | | | 2.00 | | | | 0.66[3] |
| 6 (137) | 58.00 | | | 16.00 | 26.00 | | | | | | | 1.00[3] |
| 7 (141) | 44.00 | 11.00 | 11.00 | | 25.00 | 4.00 | 1.00 | 2.00 | 3.00 | | | 2.00[3] |
| 8 (142) | 44.00 | 11.00 | 11.00 | | 25.00 | 4.00 | 1.00 | 2.00 | 3.00 | | | 1.00[1] |
| 9 (143) | 44.00 | 11.00 | 11.00 | | 25.00 | 4.00 | 1.00 | 2.00 | 3.00 | | | 1.00[2] |
| 10 (144) | 56.00 | 12.00 | 5.00 | | 24.00 | | | 2.00 | | | | 0.00[2] |
| 11 (148) | 56.00 | 12.00 | 5.00 | | 24.00 | | | 2.00 | 1.00 | | | 1.00[3] |
| 12 (149) | 57.00 | 12.00 | 5.00 | | 22.00 | | | 2.00 | 1.00 | | | 1.00[2] |
| 13 (150) | 58.00 | 12.00 | 5.00 | | 19.00 | | | 2.00 | 1.00 | | | 3.00[2] |
| 14 (152) | 73.2 | 10.9 | | | | | | 1 | | | 13.8 | 1.00[2] |
| 15 (153) | 57 | 12 | 5 | | | | | 2 | | 2 | | 1.00[2] |
| 16 (154) | 57 | 12 | 5 | | 21 | | | 4 | | | | 1.00[2] |

*- All samples used fumed silica (TS-530) as a partitioning agent at levels of less than 1.0 wt %.
ADCA- azodicarbonamide
AO - ammonium oxalate
AN - ammonium nitrate
5-ATZ - 5-aminotetrazole
[1]-Polystyrene
[2]-Polymethylmethacrylate
[3]-Viton B The dried and granulated composition was then combined with the binder and pelletized in a rotary pellet press. The pellets or tablets were 5 mm in diameter and about 2 mm in height. The formed pellets for each sample were then loaded into six steel inflator housings. About 30 gms of the pellets were loaded into each of the steel housings. The housings also contained a stainless steel knitted wire slag filter and a stainless steel burst foil with a thickness of about 0.10 mm. The six (6) apertures or exhaust ports for the gases generated by the generant were about 2.8 mm in diameter. Those skilled in the art will appreciate that the number of required apertures and their diameter are related and various combinations of aperture number and diameter can be used successfully to produce the output required for a given application. The test inflator housing had a combustion chamber volume of about 50 $cm^3$, with a separate chamber containing a filter. Between these two chambers was a plate with sixteen (16) holes 4 mm in diameter. This plate was covered on the generant side with the burst foil. The use of the burst foil separates the generant from the filter and allows the combustion chamber to be rapidly pressurized after ignition of the generant.

EXAMPLE III

Testing of Gas Generants

The assembled inflators containing the various gas generants were evaluated in a 60 liter test tank fitted with equipment to record the pressure and time profile of the combustion chamber and to record the pressure and time profile in the tank caused by the gases exiting the inflator and to analyze the gases exiting the inflator. The amount of particulate or slag produced by the burning generant was also determined. The inflators were installed into the tank and ignited. Following venting of the tank to the atmosphere, the interior of the 60 liter tank was carefully scrubbed and rinsed with deionized water to measure particulate production. The aqueous mixture of the soluble reaction products and the insoluble dust were then analyzed to determine total particulate production.

The inflators were also evaluated in a 2.83 $m^3$ (100 cubic foot) test chamber. This test is designed to simulate the interior volume of the standard automobile. Gas analysis and airborne particulate analysis were conducted in this test. The test equipment consisted of a 2.83 $m^3$ foot steel chamber containing a steering wheel simulator. To the chamber was attached a vacuum pump, flow meter, filters and a Fourier Transform Infrared Spectrometer (FTIR). The inflator was attached to the simulated steering wheel assembly within the chamber, the chamber was sealed and the gas generant ignited. Immediately after firing of the inflator, gas samples were withdrawn from the tank for analysis. Gas samples were analyzed using the FTIR spectrometer at zero time and at 1, 5, 10, 15 and 20 minute intervals from ignition. Airborne particulate production was also be measured using the 2.83 $m^3$ test chamber by filtering post-ignition air from the chamber through a fine filter and measuring the weight gained by the filter.

Table II sets forth the data collected for this experiment. Table II reports the results of the gas analysis. These results, when viewed in light of Table III, indicate that the AN based gas generants of this invention produce a non-toxic gas. This data supports the benefits of a gas generant that contains AN and silicon.

TABLE II

Gas Analysis
(Average of 3 Runs at Sample Times of 1, 5, 10, 15 and 20 minutes)

| Sample # | CO | $CO_2$ | GAS (ppm) NO | $NO_2$ |
|---|---|---|---|---|
| 1 (99) | 96 | 1009 | 27 | 5.7 |
| 2 (102) | 175 | 900 | ND | ND |
| 3 (125) | 150 | 387 | 9 | 2 |
| 4 (128) | 145 | 387 | 50 | 15 |
| 7 (141) | 201 | 382 | 6 | 1.5 |
| 8 (142) | 210 | 368 | 4 | 1 |
| 9 (143) | 163 | 325 | 5 | 4 |
| 10 (144) | 213 | 376 | 7 | 1.2 |
| 11 (148) | 182 | 377 | 6 | 0.9 |
| 12 (149) | 112 | 296 | 7 | 1.2 |
| 13 (150) | 181 | 449 | 26 | 7.8 |

ND - Not detected
** - Not determined

Gaseous Reaction Products

The automotive industry is still developing standards for the gaseous reaction products of gas generants. It is interesting to note that the objectives for airbag inflator output vary somewhat between the United States and the automobile manufacturers of Europe. Table III sets forth perceived desirable levels for the gases and particulates produced by generant compositions.

TABLE III

REACTION PRODUCT LEVELS

| Reaction Product * | USA - less than | EUROPE - less than |
|---|---|---|
| Airborne Particulates | 41.7 | — |
| Carbon Monoxide | 188 | 200 |
| Carbon Dioxide | 2000 | 16667 |
| Benzene | 83.8 | — |
| Formaldehyde | 3.3 | 3.3 |
| Nitric Oxide | 25 | 16.7 |
| Nitrogen Dioxide | 3.3 | 3.3 |
| Ammonia | 50 | 50 |
| Hydrogen Chloride | 8.3 | 8.3 |
| Hydrogen Cyanide | 8.3 | 8.3 |
| Sulfur Dioxide | 16.7 | 16.7 |
| Hydrogen Sulfate | 16.7 | 16.7 |
| Chlorine | 1.7 | 1.7 |
| Phosgene | 0.3 | 0.3 |

* - all values in ppm except Airborne Particulates in $mg/m^3$

EXAMPLE IV

In this experiment, various fuels and levels of silicon were evaluated in the gas generants of the present invention. The Samples were prepared in the manner described in Example II except the batch size was 500 gms, the components were ground separately, dry blended and pressed into strands for testing. The formulations for the samples tested are set forth in Table I.

Instead of pelletizing the gas generants as in Example II, the generant compositions were formed into rectangular strands about 10.16 cm (4 in.) in length and about 0.63 cm (¼ in.) on each side. The sides of each strand were coated with an epoxy-based adhesive. Strands were placed in a strand burner bomb. The bomb was equipped with a pressure transducer, acoustic devices and mechanical wire burn through recorders. The strands were ignited, and pressure versus time was recorded. Burning time was calculated by the acoustic and mechanical devices. Burning rate was determined by dividing the length of each pellet by its burning time. The burn rate for each sample tested is presented in Table IV.

TABLE IV

BURN RATE OF SAMPLE AT 13,790 KPA (1100 PSI)

| Sample # | Burn Rate (cm/sec.) | (in/sec.) |
|---|---|---|
| 1 (102) | 4.72 | 1.86 |
| 3 (125) | 6.86 | 2.7 |
| 8 (142) | 5.11 | 2.01 |
| 9 (143) | 4.06 | 1.6 |
| 11 (148) | 3.51 | 1.38 |
| 12 (149) | 4.70 | 1.85 |
| 13 (150) | 3.63 | 1.43 |
| 14 (152) | 1.02 | 0.4 |
| 15 (153) | 1.27 | 0.5 |
| 16 (154) | 2.46 | 0.97 |

While burn rates of greater than 1.27 cm/sec. (0.5 in/sec) are desirable, samples 14 and 15 could be improved through manipulation of the fuel/oxidizer ratio.

Industrial Applicability

The automobile industry is constantly searching for gas generants that are low in cost and produce low particulate levels with reduced levels of undesirable gases. The industry is also in need of gas generants that do not use azide based generants to avoid the problems associated with azide toxicity and disposal. The present invention is specifically directed to the non-azide based generants using a major amount of PSAN. Thus, the use of 35–80 wt. % of 5–7.0 wt. % silicon and up to 7.0 wt. % iron oxide in gas generants will address the needs of the industry and promote the use of non-azide-based gas generants.

Although the present invention has been disclosed in connection with a few preferred embodiments thereof, variations and modifications may be chosen by those skilled in the art without departing from the principles of the invention. All of these variations and modifications are considered to be within the spirit and scope of the present invention as disclosed in the foregoing description and defined by the appended claims.

We claim:

1. A high conversion gas generant comprising:

(a) 15–30 wt. % of a non-azide fuel wherein the fuel is selected from a group consisting of azoles, aminotetrazoles and the metal salts thereof, tetrazoles and the metal salts thereof, bitetrazoles and the metal salts thereof, triazoles and the metal salts thereof, azodicarbonamide, ammonium oxalate, and mixtures thereof;

(b) 35–80 wt.% of phase stabilized ammonium nitrate; and (c) 0.5–7 wt. % silicon.

2. The gas generant according to claim 1 additionally comprising 0.5–7 wt. % iron oxide and up to 5.0 wt. % of an organic binder.

3. The gas generant of claim 1 additionally comprising an oxidizer selected from transition metal oxides; alkali metal nitrates, alkaline earth metal nitrates and mixtures thereof.

4. The gas generant of claim 1 wherein said fuel is selected from 5-aminotetrazole, azodicarbonamide, ammonium oxalate and mixtures thereof and said generant additionally comprises potassium nitrate and strontium nitrate.

5. The gas generant of claim 4 wherein said fuel is 20–26 wt. % of said generant, said potassium nitrate is about 11 wt. % of said generant and said strontium nitrate is about 11 wt. % of said generant.

6. The gas generant of claim 5 wherein said phase stabilized ammonium nitrate is at least 40 wt. % of said generant and said silicon is 1–3 wt. % of said generant.

7. The gas generant of claim 5 wherein said fuel is about 25 wt. % of said generant.

8. A gas generant composition comprising:

(a) 15–30 wt. % of a fuel selected from tetrazoles, triazoles azodicarbonamide, ammonium oxalate, and mixtures thereof;

(b) 35–80 wt. % of an oxidizer system comprising ammonium nitrate and at least one compound selected from transition metal oxides; alkali and alkaline earth metal nitrates; and mixtures thereof;

(c) 0.5–7 wt. % silicon;

(d) 1–5 wt. % iron oxide; and (e) up to 5 wt. % of an organic binder.

9. The gas generant of claim 8 wherein said fuel is selected from 5-aminotetrazole azodicarbonamide, ammonium oxalate and mixtures thereof and said oxidizer system comprises ammonium nitrate, potassium nitrate and strontium nitrate.

10. The gas generant of claim 9 wherein said fuel is 20–26 wt. % of said generant; said potassium nitrate is 11 wt. % of said generant; said strontium nitrate is 11 wt. % of said generant and said ammonium nitrate is 44 wt. % of said generant.

11. The gas generant of claim 10 wherein said silicon is about 2 wt. % of said generant.

12. A gas generant composition comprising:

(a) a non-azide fuel;

(b) an oxidizer system comprising at least 40 wt. % phase stabilized ammonium nitrate;

(c) at least 0.5 wt. % silicon; and (d) at least one compound selected from the group consisting of: silica, calcium carbonate, iron oxide and elastomeric binders.

13. The gas generant of claim 12 consisting essentially of:

(a) 25 wt. % 5-aminotetrazole;

(b) 11 wt. % strontium nitrate;

(c) 11 wt. % potassium nitrate;

(d) 4 wt. % calcium carbonate;

(e) 1 wt. % silica;

(f) 44 wt. % ammonium nitrate;

(g) 3.0 wt. % iron oxide;

(h) 2 wt. % silicon; and (i) 1 wt. % of an elastomer binder.

14. A non-azide gas generant composition that, upon combustion produces gases comprising:

(a) phase stabilized ammonium nitrate;

(b) at least one nitrogen containing fuel selected from the group consisting of triazoles, tetrazoles, azodicarbonamide, ammonium oxalate and the salts thereof, and mixtures thereof;

(c) 0.5–7.0 wt. % of silicon; and (d) iron oxide.

15. The gas generant composition according to claim 14 wherein the ratio of phase stabilized ammonium nitrate to fuel is adjusted such that the amount of oxygen in said gases is less than 3.0% by volume.

16. The gas generant composition according to claim 14 wherein the amount of said phase stabilized ammonium nitrate is about 40 to 50 wt. % of the composition and said fuel is selected from 5-aminotetrazole (5-ATZ), azodicarbonamide, ammonium oxalate and mixtures thereof.

17. The gas generant composition according to claim 16 comprising a mixture of:

(a) phase stabilized ammonium nitrate at about 55 wt. %;

(b) 5-ATZ at about 25 wt. %; and (c) silicon at about 2.0 wt. %.

18. The non-azide gas generant composition according to claim 14 in pellet form wherein the burning rate of said pellet is substantially greater than 1.2 cm per second at 6.9 MPa.

19. The gas generant composition according to claim 14 additionally comprising a polymeric binder selected from the group consisting of epoxy, polycarbonate, polymethylmethacrylate, polyester, polyurethane, butadiene rubber, styrene butadiene rubber and mixtures of two or more of said polymers.

20. A gas generant comprising:

(a) a non-azide fuel at a concentration of 22–26 wt. %;

(b) an oxidizer system comprising ammonium nitrate, strontium nitrate and potassium nitrate at a concentration of 35–80 wt. % wherein the weight ratio of ammonium nitrate to strontium nitrate to potassium nitrate can range from 2:1:1 to 12:1:3;

(c) silicon at a concentration of 0.5–7.0 wt. %; and (d) iron oxide at a concentration of 1.0–5.0 wt. %.

21. The gas generant according to claim 20 wherein the weight ratio of ammonium nitrate to strontium nitrate to potassium nitrate is about 4:1:1.

22. The gas generant according to claim 21 wherein said oxidizer system is at a concentration of about 66 wt. %.

23. A gas generant comprising:

(a) 5-aminotetrazole;

(b) strontium nitrate;

(c) potassium nitrate;

(d) silicon;

(f) ammonium nitrate;

(g) iron oxide; and (h) an elastomer binder.

* * * * *